US006214288B1

(12) United States Patent
Kusunoki et al.

(10) Patent No.: US 6,214,288 B1
(45) Date of Patent: Apr. 10, 2001

(54) METHOD FOR THE PREPARATION OF A RARE EARTH PERMANENT MAGNET

(75) Inventors: Matou Kusunoki; Takehisa Minowa, both of Fukui-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/456,494

(22) Filed: Dec. 8, 1999

(30) Foreign Application Priority Data

Dec. 11, 1998 (JP) ..... 10-352710

(51) Int. Cl.[7] ..... B22F 1/00

(52) U.S. Cl. ..... 419/38; 419/54; 148/101; 148/103; 148/301; 148/302

(58) Field of Search ..... 148/101, 103, 148/301, 302; 419/38, 54

(56) References Cited

U.S. PATENT DOCUMENTS 5,129,964 * 7/1992 Anderson ..... 148/104
5,834,663 * 11/1998 Fukuno et al. ..... 75/244

FOREIGN PATENT DOCUMENTS 0 365 079 4/1990 (EP) .

OTHER PUBLICATIONS

Patent Abstracts of Japan, 011(No. 104)(E–494) Apr. 2, 1987—Abstract of JP61–252604A.

Patent Abstracts of Japan, 017(No. 148)(E–1338), Mar. 24, 1993—Abstract of JP04–314307A.

Patent Abstracts of Japan, 017(No. 398)(E–1403), Jul. 23, 1993—Abstract of JP05–074618A.

Patent Abstracts of Japan, 1996(No. 04), Apr. 30, 1996—Abstract of JP07–335468A.

* cited by examiner

*Primary Examiner*—Ngoclan Mai
(74) *Attorney, Agent, or Firm*—Wenderoth, Lind & Ponack, L.L.P.

(57) ABSTRACT

An improvement is proposed in the powder metallurgical method for the preparation of a rare earth-based permanent magnet comprising the steps of compression-molding a magnet alloy powder into a powder compact and sintering the powder compact into a sintered magnet body. The improvement, which has an effect of increasing the density of the sintered body and consequently increased magnetic properties of the magnet product, comprises conducting the sintering heat treatment in two steps consisting of a first partial sintering treatment in vacuum or under a subatmospheric pressure of an inert gas immediately followed by a second partial sintering treatment under a normal to superatmospheric pressure of, for example, up to 20 atmospheres.

5 Claims, No Drawings

METHOD FOR THE PREPARATION OF A RARE EARTH PERMANENT MAGNET

BACKGROUND OF THE INVENTION

The present invention relates to a method for the preparation of a rare earth-based permanent magnet. More particularly, the invention relates to a method for the preparation of a neodymium/iron/boron-based permanent magnet by a powder metallurgical process involving a step of sintering of a powder compact of a magnet alloy of a specified chemical composition of the rare earth-based magnet alloy.

As is well known, the demand for rare earth-based permanent magnets is rapidly growing in recent years by virtue of their very excellent magnetic properties enabling a compact design of electric and electronic instruments with a permanent magnet built therein despite the relative expensiveness of the rare earth-based magnets as compared with ferrite-based and other conventional permanent magnets. Among the various types of rare earth-based permanent magnets, the samarium-based magnets developed in early days are under continuous replacement with neodymium-based permanent magnets or, in particular, neodymium/iron/boron-based magnets because the magnetic properties of the magnets of this latter type definitely exceed those of the former type in addition to the lower manufacturing costs owing to the relative inexpensiveness of the elements constituting the magnets.

As is also well known, the neodymium-based permanent magnets are prepared, like the rare earth-based magnets of other types, by a powder metallurgical process comprising the steps of pulverization of an alloy ingot of a specified composition of the constituent elements, e.g., neodymium, iron and boron, into a fine magnet alloy powder, compression-molding of the alloy powder, usually, in a magnetic field, into a powder compact and a sintering heat treatment of the powder compact as a green body at an elevated temperature under controlled conditions.

It is generally accepted that the magnetic properties of the thus prepared neodymium-based permanent magnets are greatly affected by the process conditions of the step of sintering heat treatment. For example, the residual magnetization of the magnet can be increased by bringing the density of the sintered magnet body as close as possible to the true density of the respective magnet alloy. Needless to say, the density of a sintered magnet body can be increased by increasing the sintering temperature and by extending the time length for the sintering treatment.

These measures to accomplish an increase in the density of the sintered magnet body can not always be applied with success to the neodymium-based permanent magnet having relatively large temperature dependence of the coercive force because an increase in the sintering temperature and/or extension of the sintering time results in undue growth of the sintered grains while coarser sintered grains have a lower coercive force than finer grains as a trend. This problem explains the residual magnetization of the neodymium-based magnets currently under use which is substantially lower than the value expected ed for an imaginary magnet having a sintering density identical to the true density of the magnet alloy.

In this regard for accomplishing a high residual magnetization, a proposal is made in Japanese Patent Publication 4-45573 for a measure of bringing the density of a sintered body of a neodymium-based magnet to a value close to the true density of the alloy with a relatively small decrement of the coercive force, according to which the density of the sintered magnet can be increased by conducting the compression molding of the magnet alloy powder by using a hot hydrostatic press under a hydrostatic pressure of 500 to 1300 atmospheres. Needless to say, a large problem involved in this method of high-pressure hydrostatic compression molding is that the hydrostatic pressure can be obtained only by using a very highly pressure-resistant vessel which is, even by setting aside the large weight and expensiveness, under strict legal regulations for safety and must be used and maintained with utmost care. In addition, this hydrostatic molding method is disadvantageous due to the low productivity taking a long time for one-shot molding resulting in an increase in the manufacturing costs of the magnet products.

Alternatively, Japanese Patent Kokai 7-335468 proposes a heat treatment under a pressure in the range from 50 to 500 atmospheres to accomplish densification of the sintered magnet body. Although the pressure can be substantially lower than in the above described method proposing a pressure of 500 to 1300 atmospheres, the disadvantage due to the requirement for a highly pressure-resistant vessel still remains unsolved.

The disadvantage caused by a low density of the sintered neodymium-based permanent magnets is not limited to a decrease in the magnetic properties such as the residual magnetization. Namely, a neodymium-based sintered magnet having an insufficient density as sintered is liable to suffer drawbacks such as low mechanical strengths of the magnet body, rusting on the surface and poor adhesive bonding of the rustproofing coating layers provided on the magnet surface.

SUMMARY OF THE INVENTION

The present invention accordingly has an object to provide a simple, convenient and inexpensive method for the preparation of a high-density rare earth-based permanent magnet having a large residual magnetization and a practically sufficient coercive force without necessitating use of an elaborate and expensive but poorly productive apparatus.

Thus, the present invention provides, in a method for the preparation of a rare earth-based permanent magnet comprising the steps of:

(a) compression-molding a powder of a rare earth-based magnet alloy having a chemical composition expressed by the composition formula giving the molar proportion of the constituent elements $$R_X(Fe_{1-a}Co_a)_YB_ZT_b, \quad (I)$$

In which R is a rare earth element, T is an element selected from the group consisting of aluminum, silicon, vanadium, chromium, manganese, nickel, copper, zinc, gallium, zirconium, niobium, molybdenum, tin, hafnium, tantalum and tungsten, the subscript X is a number in the range from 11 to 16, the subscript Y is a number in the range from 70 to 85, the subscript Z is a number in the range from 4 to 9, the subscript a is 0 or a positive number not exceeding 0.2 and the subscript b is 0 or a positive number not exceeding 4, in a magnetic field into a powder compact; and (b) subjecting the powder compact to a heat treatment to effect sintering to give a sintered magnet body, the improvement which comprises conducting the heat treatment of the powder compact in step (b) in two partial heat treatment steps consisting of:

(b1) a first partial sintering step conducted in vacuum or in an atmosphere of an inert gas under a subatmospheric pressure at a temperature in the range from 1000 to 1150° C. until the density of the powder compact under sintering reaches from 90 to 98% relative to the true density of the magnet alloy; and (b2) a second partial sintering step conducted in an atmosphere of an inert gas under a pressure in the range from 1 to 20 atmospheres or, preferably, from 1 to 10 atmospheres at a temperature in the range from 900 to 11 50° C. for 0.1 to 5 hours.

DETAILED DESCRIPTION OF THE PREFERRED EMBODIMENTS

As is summarized above, the improvement accomplished according to the invention, which has been completed as a result of the inventors' extensive investigations with an object to overcome the disadvantages accompanying the use of a high pressure of 500 to 1300 atmospheres or 50 to 500 atmospheres proposed in the prior art, is characterized by conducting the sintering heat treatment of a powder compact in two steps. Despite the unnecessity of using such a high pressure, the rare earth-based permanent magnet obtained according to the present invention has a high density close to the true density of the magnet alloy to give a large residual magnetization along with a practically sufficient coercive force.

The preparation method according to the present invention is applicable to a rare earth-based magnets of any chemical compositions but the improvement obtained by the invention is particularly great when the magnet alloy, from which the rare earth-based permanent magnet is prepared, has a chemical composition expressed by the composition formula $$R_X(Fe_{1-a}Co_a)_YB_ZT_b, \quad (I)$$

In which R is a rare earth element, T is an element selected from the group consisting of aluminum, silicon, vanadium, chromium, manganese, nickel, copper, zinc, gallium, zirconium, niobium, molybdenum, tin, hafnium, tantalum and tungsten, the subscript X is a number in the range from 11 to 16, the subscript Y is a number in the range from 70 to 85, the subscript Z is a number in the range from 4 to 9, the subscript a is 0 or a positive number not exceeding 0.2 and the subscript b is 0 or a positive number not exceeding 4.

In the above given composition formula of the magnet alloy, the symbol R denotes a rare earth element or a combination of two kinds or more of rare earth elements selected from the group consisting of yttrium and the elements having an atomic number of 57 to 71 either singly or as a combination of two kinds or more. It is preferable that the rare earth element R is neodymium or a combination of neodymium with a minor molar proportion of other rare earth elements such as dysprosium. The symbol T in the formula denotes an element, which is an optional additive ingredient in the magnet alloy, selected from the group consisting of aluminum, silicon and transition metal elements including titanium, vanadium, chromium, manganese, nickel, copper, zinc, gallium, zirconium, niobium, molybdenum, tin, hafnium, tantalum and tungsten either singly or as a combination of two kinds or more. Although the molar proportion of the respective elements including R, Fe, Co, B and T is defined by the values of the subscripts X, Y, Z, a and b in the formula, it is within the scope of the invention that the magnet alloy contains each a small amount of carbon, oxygen, nitrogen, hydrogen and other impurity elements unavoidably brought into the magnet alloy in the preparation procedure.

The subscripts in the formula (I) each have a value that the subscript X is a number in the range from 11 to 16, the subscript Y is a number in the range from 70 to 85, the subscript Z is a number in the range from 4 to 9, the subscript a is 0 or a positive number not exceeding 0.2 and the subscript b is 0 or a positive number not exceeding 4. When the value of X is too small, the coercive force of the magnet is greatly decreased due to precipitation of the α-iron phase while, when X exceeds 16, a decrease is resulted in the residual magnetization of the magnet. When the value of Y is too small, a decrease is resulted in the residual magnetization of the magnet while, when Y is too large, a decrease is resulted in the coercive force of the magnet due to precipitation of the α-iron phase. When the value of Z is too small, a great decrease is caused in the coercive force of the magnet due to precipitation of the phase of, for example, $Nd_2Fe_{17}$ while, when Z is too large, a decrease is resulted in the residual magnetization due to an undue increase in the amount of the non-magnetic phase of, for example, $NdFe_4B_4$.

The subscript a defines the molar proportion of iron and cobalt. It is known that partial replacement of iron with cobalt has an effect to increase the residual magnetization of the magnet while, when the molar proportion of cobalt is too large, a great decrease is resulted in the coercive force of the magnet.

While addition of the optional additive element denoted by T in the alloy composition has an effect of increasing the coercive force of the magnet, this advantageous effect is less prominent when the value of the subscript b exceeds 4 rather with a great decrease in the residual magnetization of the magnet.

In the preparation of the magnet alloy powder, the constituent elements including R, Fe, Co, B and T each in the elementary form are taken in a proportion to meet the composition formula (I) given above and they are melted together by high-frequency induction heating in vacuum or in an atmosphere of an inert gas such as argon to give a uniform melt for casting into an alloy ingot. Thereafter, the alloy ingot is crushed in a jaw crusher or other suitable machines into coarse particles which are finely pulverize, for example, in a jet mill into fine particles having an average particle diameter of 1 to 20 μm. In step (a) of the preparation method according to the present invention, the magnet alloy powder obtained in the above described manner and filling the cavity of a metal mold is compression-molded under a compressive force of 1 to 2 tons/cm$^2$ in a magnetic field of about 15 kOe to give a powder compact having a density of 3 to 5 g/cm$^3$, in which the magnetic alloy particles are oriented to have their easy magnetization axes aligned in the direction of the magnetic field applied in the compression molding.

The powder compact of the magnet alloy particles obtained in the above described manner is then subjected in step (b) to a sintering heat treatment, which is the most characteristic step in the preparation method according to the invention and conducted in two steps consisting of a first and a second partial sintering treatment steps (b1) and (b2). It is essential that the two partial sintering steps (b1) and (b2) are undertaken consecutively without intermission or intermediate cooling.

The first partial sintering treatment (b1) of the powder compact is undertaken in vacuum or in an atmosphere of an inert gas such as argon under a subatmospheric pressure, i.e. a pressure lower than the pressure of normal atmosphere, which is preferably 200 Torr or lower in order to eliminate the pores in the powder compact, at a temperature in the range from 1000 to 1150° C. This first partial sintering treatment is conducted until the density of the powder compact under sintering reaches 90 to 98% of the true density of the magnet alloy taking a time from 0.1 to 5 hours, though dependent on the sintering temperature and other factors, to effect substantial disappearance or coalescence of the open pores in the powder compact. The sintering temperature is limited in the above mentioned range because, when the temperature is too low, the density of the powder compact on the way of sintering can hardly reach the desired value even by extending the sintering time to exceed 5 hours resulting in a decrease in the productivity of the preparation process while, when the sintering temperature is too high, excessive grain growth of the magnet alloy particles proceeds along with an undue increase of the density of the body to exceed the desirable upper limit even by discontinuing sintering after 0.1 hour or even shorter resulting in a great decrease in the coercive force of the sintered magnet so as to affect the reproducibility and reliability of the preparation process.

The intermediate magnet body under the way of sintering is then subjected to the second partial sintering treatment (b2) which is undertaken in an atmosphere of an inert gas such as argon under a pressure in the range from 1 to 20 atmospheres or, preferably, from 1 to 10 atmospheres at a temperature in the range from 900 to 1150° C. or, preferably, from 960 to 11 50° C. for a length of time in the range from 0.1 to 5 hours or, preferably, from 0.5 to 4 hours.

The pressure of the atmosphere for this second partial sintering treatment is limited in the above mentioned normal superatmospheric range of pressure because, when the pressure is too low, the desired advantageous effect on the density of the sintered body can hardly be obtained along with undue grain growth resulting in a decrease in the coercive force of the magnet while no particular additional advantages can be obtained by increasing the pressure to exceed the above mentioned upper limit rather with an economical disadvantage due to expensiveness of a highly pressure-resistant vessel leading to an increase of the production costs.

The sintering temperature is limited in the above mentioned range because, when the temperature is too low, sintering of the magnet body to increase the density proceeds only at an unduly low rate resulting in a decrease in the productivity of the manufacturing process while, when the temperature is too high, the rate of density increase of the magnet body is so high and accompanied by undue grain growth leading to a great decrease in the coercive force of the sintered magnet.

It is advantageous to select the sintering time of this second partial sintering treatment (b2) in the range from 0.1 to 5 hours or, preferably, from 0.5 to 4 hours in order to precisely control the effects to be obtained by the second partial sintering treatment. This is because, when the time is too short, the desired sintering effect under pressurization can hardly be controlled with reproducibility by the treatment of a so short time while, when the time is too long, the sintered magnet would suffer a decrease in the coercive force due to undue grain growth, if not to mention the disadvantage in the productivity of the process due to prolongation of the treatment.

It is the novel and unexpected discovery leading to the present invention that densification of a magnet body under sintering by pressurization with an inert gas in the second partial sintering treatment (b2) can be fully efficient only when the magnet body to be subjected to this partial sintering treatment (b2) has a density of 90 to 98% relative to the true density of the magnet alloy attained in the first partial sintering treatment (b1) under a subatmospheric pressure resulting in substantial disappearance of open pores in the body. When the first partial sintering treatment (b1) is undertaken under improper conditions relative to the temperature and time, it is almost always unavoidable that the coercive force of the sintered magnet is decreased due to undue grain growth. This disadvantage can be overcome by conducting the first partial sintering treatment (b1) according to the present invention to give a finally sintered magnet without undue grain growth and hence without a decrease in the coercive force despite the very high density of the sintered magnet close to the true density of the magnet alloy.

Since two steps of partial sintering heat treatments under different conditions are undertaken consecutively without intermission, the liquid phase formed in the first partial sintering step (b1) remains also in the second partial sintering step (b2) to favorably effect on the sintering process under a superatmospheric pressure in an atmosphere of an inert gas resulting in a high density of the sintered magnet body. The effect of pressurization in the second step (b2) is particularly remarkable when a certain degree of densification of the body under sintering has been accomplished in the first step (b1) so that the increase in the sintering pressure for the second step (b2) can be so moderate.

The sintered magnet body obtained in the above described steps (b1) and (b2) is usually further subjected to an aging treatment at a temperature substantially lower than the sintering temperature under conventional conditions followed by mechanical working and surface treatment to give a finished rare earth-based permanent magnet product.

In the following, the present invention is illustrated in more detail by way of Examples and Comparative Examples, which, however, never limit the scope of the invention in any way.

EXAMPLES 1 to 3 AND COMPARATIVE EXAMPLES 1 AND 2.

An ingot of a magnetic alloy having a chemical composition expressed by the formula $Nd_{13.8}Dy_{0.5}Fe_{73.7}Co_{5.0}B_{6.0}Al_{0.5}V_{0.5}$ was prepared by melting together each a specified amount of the respective ingredients in an elementary form of at least 99.9% by weight purity under an atmosphere of argon in a high-frequency induction heating furnace. The alloy ingot was crushed by using a jaw crusher and Brown mill into coarse particles which were finely pulverized in a jet mill using nitrogen as the jet gas into fine magnetic particles having an average particle diameter of 5 $\mu$m. The thus obtained magnet alloy powder was compression-molded into powder compacts in the cavity of a metal mold under a compressive pressure of about 2 tons/cm$^2$ with application of a magnetic field of about 15 kOe in a direction perpendicular to the direction of the compressive pressure.

Some of the powder compacts were subjected to a first partial sintering heat treatment at 1080° C. in vacuum for 60 minutes to give partially sintered magnet bodies having a bulk density of 7.3 g/cm$^3$, which was about 95% of the true density of the alloy.

The rest of the powder compacts were subjected to the two-step sintering heat treatment by undertaking the above described first partial sintering treatment immediately followed by the second partial sintering treatment at 1040° C. for 240 minutes in an atmosphere of argon under varied pressures of 0.5, 5, 9 and 20 atmospheres. Separately, the same sintering treatment as above was undertaken for some of the powder compacts except that the second partial sintering treatment was undertaken at 1120° C. for 120 minutes in vacuum.

The thus obtained sintered bodies were then subjected to an aging treatment at 600° C. for 60 minutes in an atmosphere of argon under normal pressure to give finished magnet bodies as sintered.

Evaluation of these magnet bodies was performed by measuring the density in g/cm$^3$, residual magnetic flux density Br in kG, coercive force Hc in kOe and maximum energy product $BH_{max}$ in MGOe to give the results shown in Table 1 below, which also includes the pressure in the second partial sintering treatment.

As is understood from the results in Table 1, the two-step sintering treatment according to the present invention has an effect of increasing the density, residual magnetic flux density and coercive force with a consequent increase in the maximum energy product as a single typical evaluation item of permanent magnet products. The permanent magnets obtained according to the present invention were free from defects such as cracks and chipped edges and had good mechanical strengths.

EXAMPLE 4 AND COMPARATIVE EXAMPLE 3.

Powder compacts were prepared in the same manner as in the above described experimental procedure from a neodymium-based magnetic alloy having a chemical composition expressed by the composition formula of $Nd_{13.5}Dy_{1.0}Fe_{74.5}Co_{3.0}B_{6.0}GA_{1.0}Zr_{0.5}Mo_{0.5}$. They were subjected to processing into sintered magnet bodies including the two-step sintering treatment and aging treatment under the same conditions as in Example 2 for Example 4 or as in Comparative Example 2 for Comparative Example 3. The magnet bodies under sintering after the first partial sintering treatment each had a density corresponding to about 94% of the true density of the magnet alloy.

The results of the evaluation tests for these permanent magnets are shown in Table 1.

TABLE 1

| | Pressure atmospheres | Density, g/cm$^3$ | Br, kG | Hc, kOe | $BH_{max}$, MGOe |
|---|---|---|---|---|---|
| Example 1 | 5 | 7.56 | 13.60 | 16.4 | 45.3 |
| Example 2 | 9 | 7.59 | 13.65 | 16.2 | 45.6 |
| Example 3 | 20 | 7.60 | 13.63 | 16.0 | 45.5 |
| Comparative Example 1 | 0.5 | 7.31 | 13.10 | 15.8 | 40.8 |
| Comparative Example 2 | vacuum | 7.48 | 13.47 | 14.5 | 44.1 |
| Example 4 | 9 | 7.65 | 13.14 | 18.9 | 42.3 |
| Comparative Example 3 | vacuum | 7.51 | 12.96 | 17.2 | 40.7 |

What is claimed is:

1. In a method for the preparation of a rare earth-based permanent magnet comprising the steps of:

(a) compression-molding a powder of a rare earth-based magnet alloy having a chemical composition expressed by the composition formula $$R_X(Fe_{1-a}CO_a)_Y B_Z T_b,$$

In which R is a rare earth element or a combination of rare earth elements, T is an element or a combination of elements selected from the group consisting of aluminum, silicon, titanium, vanadium, chromium, manganese, nickel, copper, zinc, gallium, zirconium, niobium, molybdenum, tin, hafnium, tantalum and tungsten, the subscript X is a number in the range from 11 to 16, the subscript Y is a number in the range from 70 to 85, the subscript Z is a number in the range from 4 to 9, the subscript a is 0 or a positive number not exceeding 0.2 and the subscript b is 0 or a positive number not exceeding 4, in a magnetic field to give a powder compact; and (b) subjecting the powder compact to a heat treatment for sintering to give a sintered body, the improvement which comprises conducting the heat treatment of the powder compact for sintering in step (b) in two partial heat treatment steps consisting of:

(b1) a first partial sintering treatment conducted in vacuum or in an atmosphere of an inert gas under a subatmospheric pressure at a temperature in the range from 1000 to 1150° C. until the density of the powder compact under sintering reaches from 90 to 98% relative to the true density of the magnet alloy; and (b2) a second partial sintering treatment conducted in an atmosphere of an inert gas under a pressure in the range from 1 to 20 atmospheres at a temperature in the range from 900 to 1150° C. for 0.1 to 5 hours.

2. The improvement as claimed in claim 1 in which the subatmospheric pressure in step (b1) is 200 Torr or lower.

3. The improvement as claimed in claim 1 in which the pressure in the second partial sintering treatment is in the range from 1 to 10 atmospheres.

4. The improvement as claimed in claim 1 in which the length of time for the second partial sintering treatment is in the range from 0.5 to 4 hours.

5. The improvement as claimed in claim 1 in which the temperature in the second partial sintering treatment is in the range from 960 to 1150° C.

* * * * *